US007309420B1

(12) United States Patent
Trangsrud

(10) Patent No.: US 7,309,420 B1
(45) **Date of Patent: *Dec. 18, 2007**

(54) SANITARY, STORM AND CATCH BASIN TRAP WITH FILTER INSERT

(75) Inventor: Julian P. Trangsrud, Northfield, MN (US)

(73) Assignee: Royal Concrete Pipe, Inc., Stacy, MN (US)

( * ) Notice: Subject to any disclaimer, the term of this patent is extended or adjusted under 35 U.S.C. 154(b) by 76 days.

This patent is subject to a terminal disclaimer.

(21) Appl. No.: 11/365,353

(22) Filed: Mar. 1, 2006

Related U.S. Application Data

(63) Continuation-in-part of application No. 10/960,582, filed on Oct. 7, 2004, now Pat. No. 7,132,045.

(51) Int. Cl.
*E03F 5/06* (2006.01)

(52) U.S. Cl. ..... 210/163; 210/164; 210/170.03; 210/474; 404/4

(58) Field of Classification Search ..... 210/163, 210/164, 166, 474, 170.03; 404/4, 5
See application file for complete search history.

(56) References Cited

U.S. PATENT DOCUMENTS 783,556 A * 2/1905 Van Buskirk ..... 210/163
1,041,887 A * 10/1912 Schodde ..... 210/163
1,654,886 A * 1/1928 Keeble et al. ..... 210/163
5,232,587 A * 8/1993 Hegemier et al. ..... 404/4
5,284,580 A * 2/1994 Shyh ..... 210/164
5,486,287 A * 1/1996 Murphy et al. ..... 210/164
5,985,157 A * 11/1999 Leckner et al. ..... 210/163
6,149,803 A 11/2000 DiLoreto, Jr. et al. ..... 210/164
6,214,216 B1 * 4/2001 Isaacson ..... 210/164
6,270,663 B1 * 8/2001 Happel ..... 210/163
6,294,095 B1 9/2001 Lewis ..... 210/747
6,368,499 B1 4/2002 Sharpless ..... 210/164
6,537,446 B1 3/2003 Sanguinetti ..... 210/163
6,551,023 B2 4/2003 Allard ..... 405/36
6,793,811 B1 * 9/2004 Fleischmann ..... 210/163
2002/0048490 A1 * 4/2002 Allard et al. ..... 210/170
2002/0113025 A1 8/2002 Gauldin et al. ..... 210/767
2004/0035772 A1 2/2004 McGinn ..... 210/163

* cited by examiner

*Primary Examiner*—Christopher Upton
(74) *Attorney, Agent, or Firm*—Steven E. Kahm; Nikolai & Mersereau, P.A.

(57) ABSTRACT

A temporary trap having baskets and optionally filters in the baskets used in conjunction with inlets for sewer systems to keep debris, oils or chemicals from being washed into the sewer during construction of roads and sewers. The trap is a box, typically rectangular, square or round, with baskets having a plurality of holes therein for allowing water to pass therethrough while trapping debris therein. The trap is inserted into a inlet by lifting the grate off the inlet frame, inserting the trap and then replacing the grating. After a rain the baskets and filters may be cleaned out and reused or replaced. When the construction project is finished the grate is lifted off the inlet frame and the trap removed. The trap has an overflow opening in case the trap becomes clogged.

21 Claims, 8 Drawing Sheets

SANITARY, STORM AND CATCH BASIN TRAP WITH FILTER INSERT

This is a continuation-in-part of application Ser. No. 10/960,582 filed Oct. 7, 2004.

BACKGROUND OF THE INVENTION

1. Field of the Invention

This invention relates to traps and filters for insertion under an inlet grating for a sanitary, storm or catch basin.

2. Description of the Related Art

When streets are under construction the catch basins for the sewers can fill up with all kinds of debris during rains. Since the construction of the area is not complete, there are many objects in the area that can be washed into the newly installed sewer and clog it up, whereas after construction, when the area is in finished condition, landscaped, fully paved, and construction-related debris is removed, fewer objects are present that can be washed into the catch basin and clog up the sewer.

SUMMARY OF THE INVENTION

An insert for an inlet frame is installed to catch debris and prevent sewers from being clogged during construction projects. The insert can then be removed when no longer needed.

The insert has the same shape and size as the inlet frame such that it fits inside and conforms to the road grade and curb cuts as does the inlet frame. A grate fits over the insert and holds it in place within the inlet frame. The insert has a housing for holding matter-catching members such as baskets, baskets with filters or filter frames for holding filters. The baskets have a plurality of holes to let water through while catching debris by preventing the debris from passing through the holes. The insert has overflow apertures for letting water pass into the sewer. An overflow may occur if the holes in the baskets or filters are blocked by debris or the water flow into the insert is higher than the restricted flow out. The basket can be easily removed from the insert to remove debris caught therein. In addition to a basket holding a filter, a filter frame may be used to hold a filter in place. A filter made out of a cloth or oil or chemical absorbing material can be placed in the baskets to catch smaller debris, sand, salts, oils and chemicals. The filter can be easily removed by hand and cleaned or replaced by another filter while the insert and or the basket remains in place, or the entire basket or filter frame can be removed. Alternatively the baskets and or filters can be vacuumed out to clean them while in the inlet frame.

During cold weather the baskets, filters, or baskets with filters may be removed from the inserts to avoid freezing and clogging of the catch basin by ice or ice and debris mixtures.

The filters may be made to collect sand, salt, oil, or other chemicals. The filters may be made in the shape of bags with ties and or drawstrings to secure the filters to the baskets, frames or wire frames which are installed in the inserts.

Debris collectors provide protection for National Pollutant Discharge Elimination System Permits and for storm water pollution prevention programs.

Inserts made out of plastics to keep costs down may need reinforcing materials or be designed with shapes to withstand the forces placed on the inserts.

OBJECTS OF THE INVENTION

It is an object of the invention to provide a temporary insert for insertion into an inlet frame or other storm water pollution orifice to capture debris preventing it from clogging a storm sewer.

It is an object of the invention to provide a filter insert for the insert to capture smaller particles and debris from clogging a storm sewer.

It is an object of the invention to provide an insert for an inlet frame to capture smaller particles and debris from clogging a storm sewer and to meet storm water pollution program requirements.

It is an object of the invention to match the temporary insert to the shape and size of the permanent curb box and grate for efficient operation.

It is an object of the invention to provide a basket from an insert in a curb box frame with apertures for capturing large debris and for easily removing the basket for cleaning it out by hand or by vacuum.

It is an object of the invention to provide a low cost insert made out of plastics with reinforcements to allow the insert to keep its shape while in use.

It is an object of the invention to provide baskets and filters, which may be easily removed during freezing temperatures to prevent blockages due to freezing.

It is an object of the invention to provide filters for capturing sand, salt, oil, or other chemical and solid wastes from entering storm sewers.

It is an object of the invention to secure a filter to a basket or frame.

Other objects, advantages and novel features of the present invention will become apparent from the following description of the preferred embodiments when considered in conjunction with the accompanying drawings.

DESCRIPTION OF THE PREFERRED EMBODIMENTS

During street construction and at other times there is an added need for traps and filters to remove debris, sand, salt, oil or other chemicals from the water flow from the street into storm drains. The larger pieces of debris can clog up sewer systems, which then need to be cleaned out. It is preferred to have a trap for catching the larger pieces of debris and optionally a filter for catching smaller objects, sands, salt, oils and or chemicals. Debris can be expected in larger quantities during construction of a road, during some maintenance projects or at other times when more than the normal amount of debris is present in the area, which can be washed into storm drains during rains.

Figure 1:
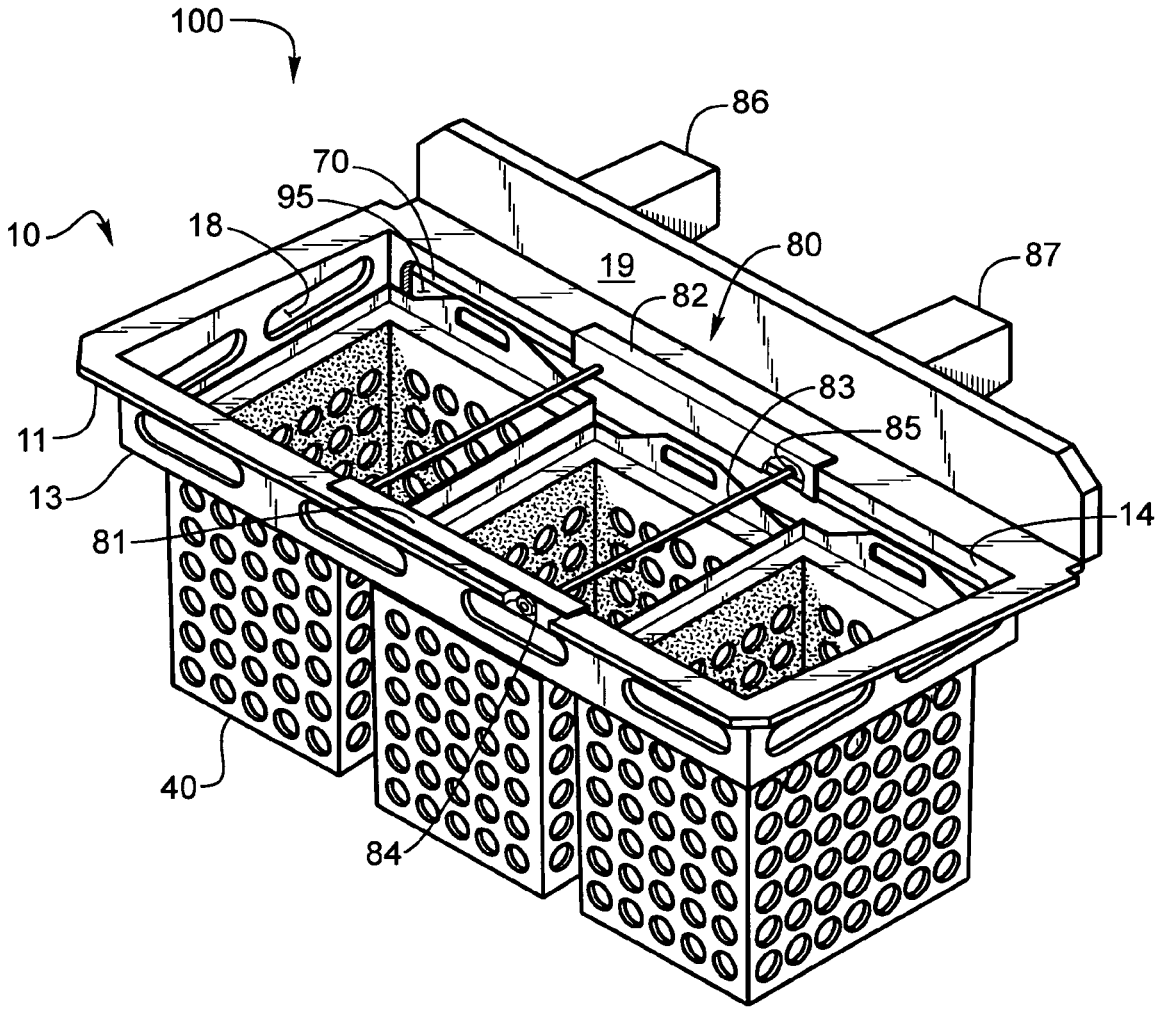
FIG. 1 is a top front perspective view of an insert housing with baskets installed.
Figure 7:
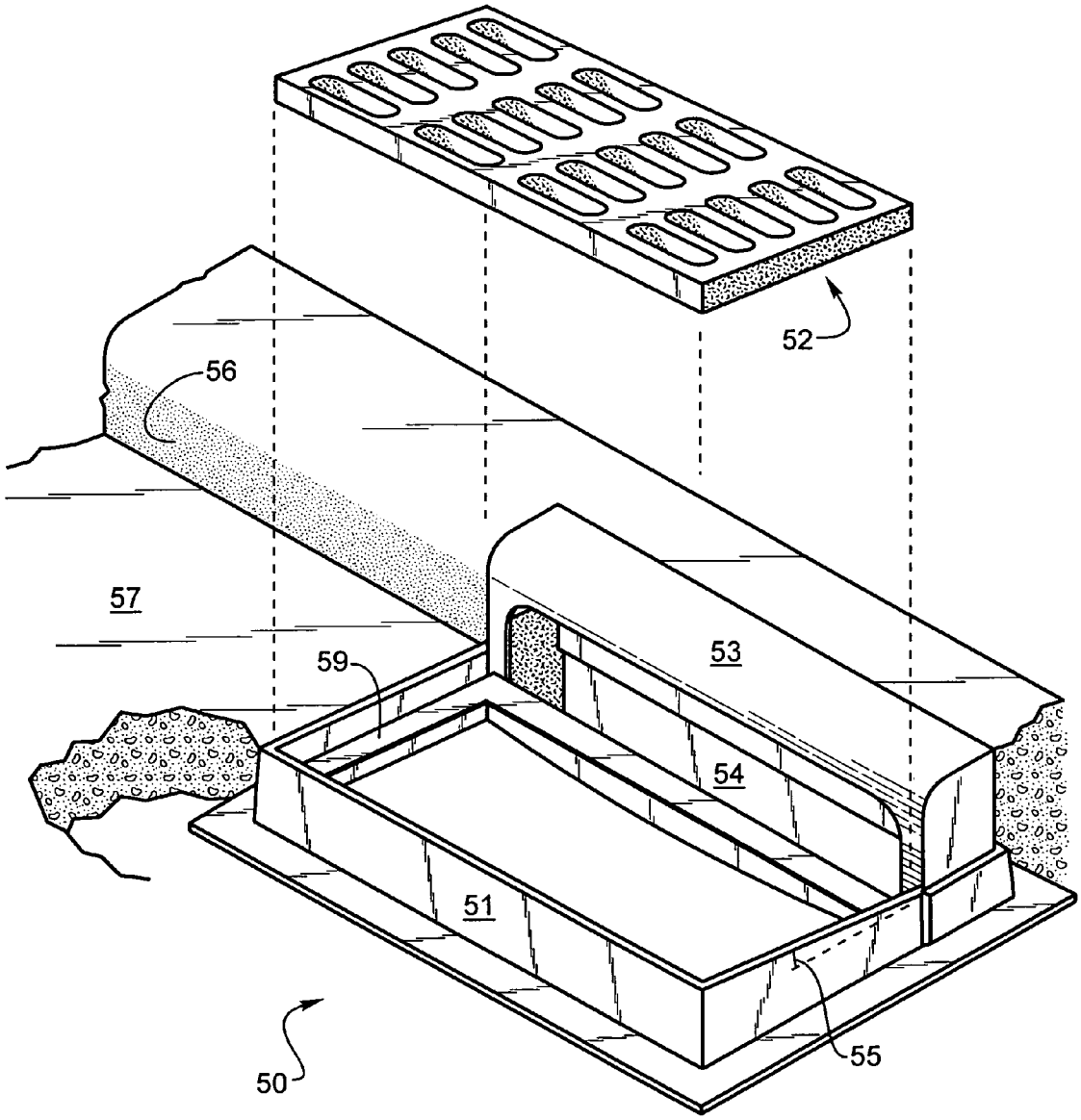
FIG. 7 is a perspective view of a inlet housing, grate and curb box inlet frame.
Figure 8:
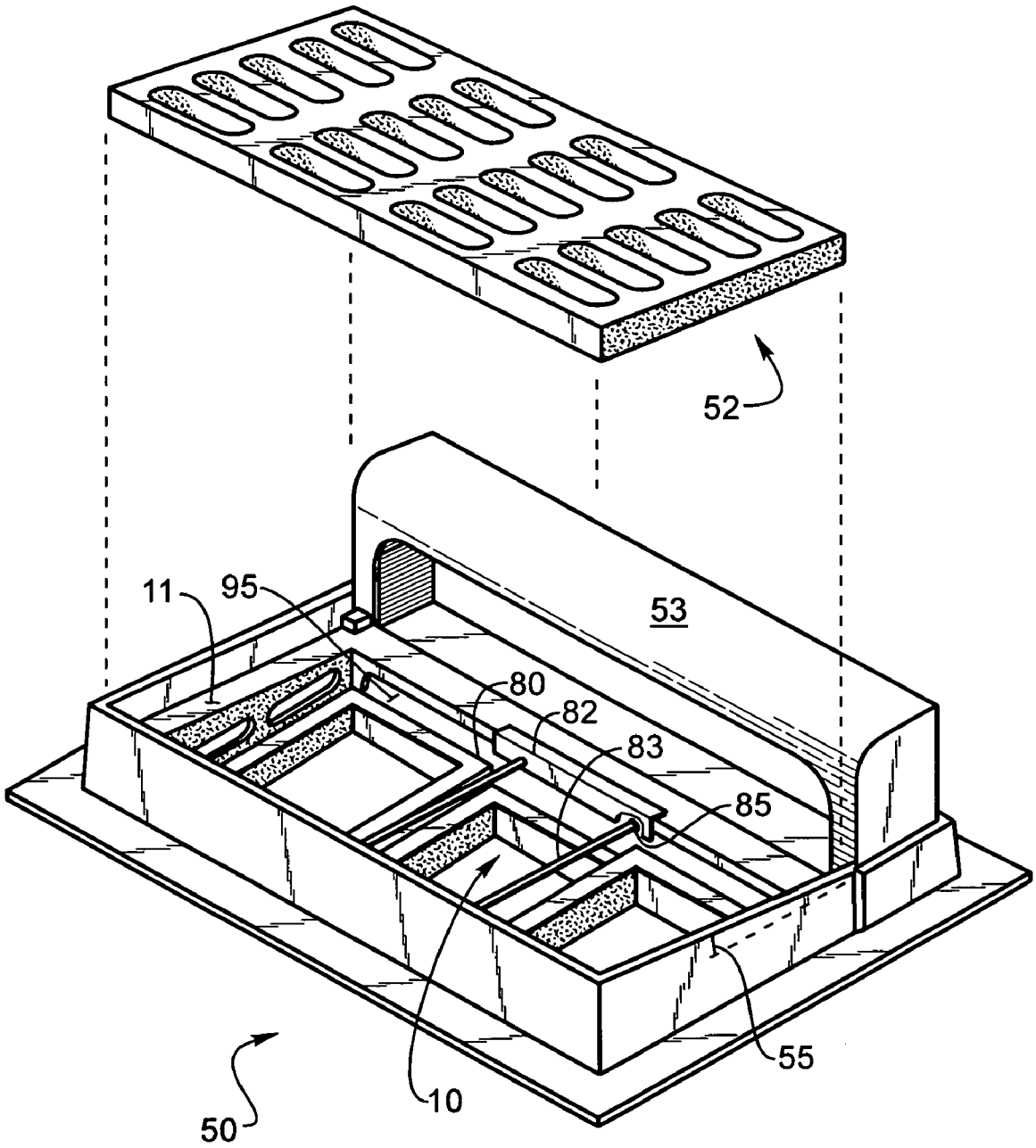
FIG. 8 is a perspective view of a curb box inlet frame with an insert housing installed.

When extra debris is present a temporary trap 100, as seen in FIG. 1, can be added to an inlet 50 as shown in FIG. 8. The temporary trap 100 has trap insert housing 10 with a flange 11 around its perimeter to engage the curb box inlet frame flange 59 (see FIG. 7) so as to secure insert housing 10 therein. Grate 52 is then placed on top of flange 11 to hold the temporary trap 100 in place.

Figure 3:
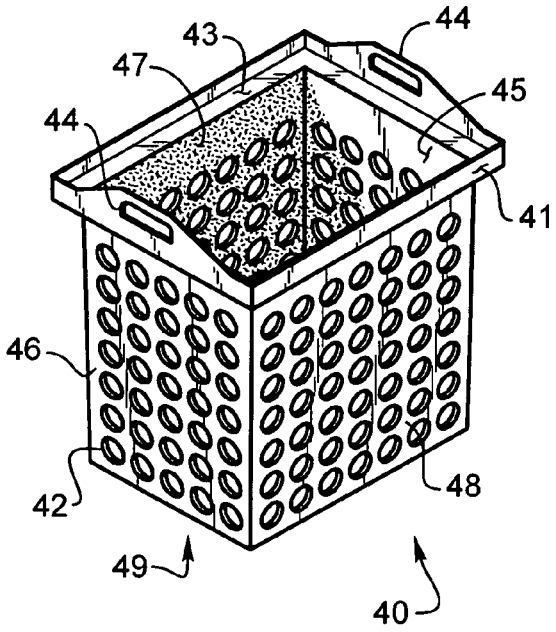
FIG. 3 is a perspective view of a basket for the insert housing.

The temporary trap 100 in FIG. 1 has an insert housing 10, and three baskets 40, including a center basket, and two end baskets. The baskets 40 (see FIG. 3) have apertures 42 on the front walls 46, rear walls 45, right side walls 47, left side walls 48, and bottoms 49. The apertures 42 allow water to pass though but block larger pieces of debris from passing therethrough. Baskets 40 also have a flange 43 around the perimeter at the top of the basket with an upstanding wall 41 on top of and at the edge of flange 43 and a handle 44 extending from the top of the upstanding wall 41. The insert housing 10 may employ a support frame 80, preferably made of stainless steel. The support frame 80 having a front flange 81 and a rear flange 82 held apart by connector rods 83 and attached to the front wall 13 and rear wall 14 of the insert housing 10 by nuts 84 securing the rods 83 to the walls 13 and 14 after the rods pass though apertures 85 in the walls 13 and 14. The support frame 80 gives extra strength to the insert housing 10 and keeps the opening shape of the top portion of the insert housing 10 from being distorted. A bar 70 may optionally be used across the top of mouth 95 to add strength to the insert housing. Supports 86 and 87 on the rear of insert housing 10 help space the insert housing 10 inside of the inlet 50 and support it therein, while adding strength to the rear wall 14.

Figure 2:
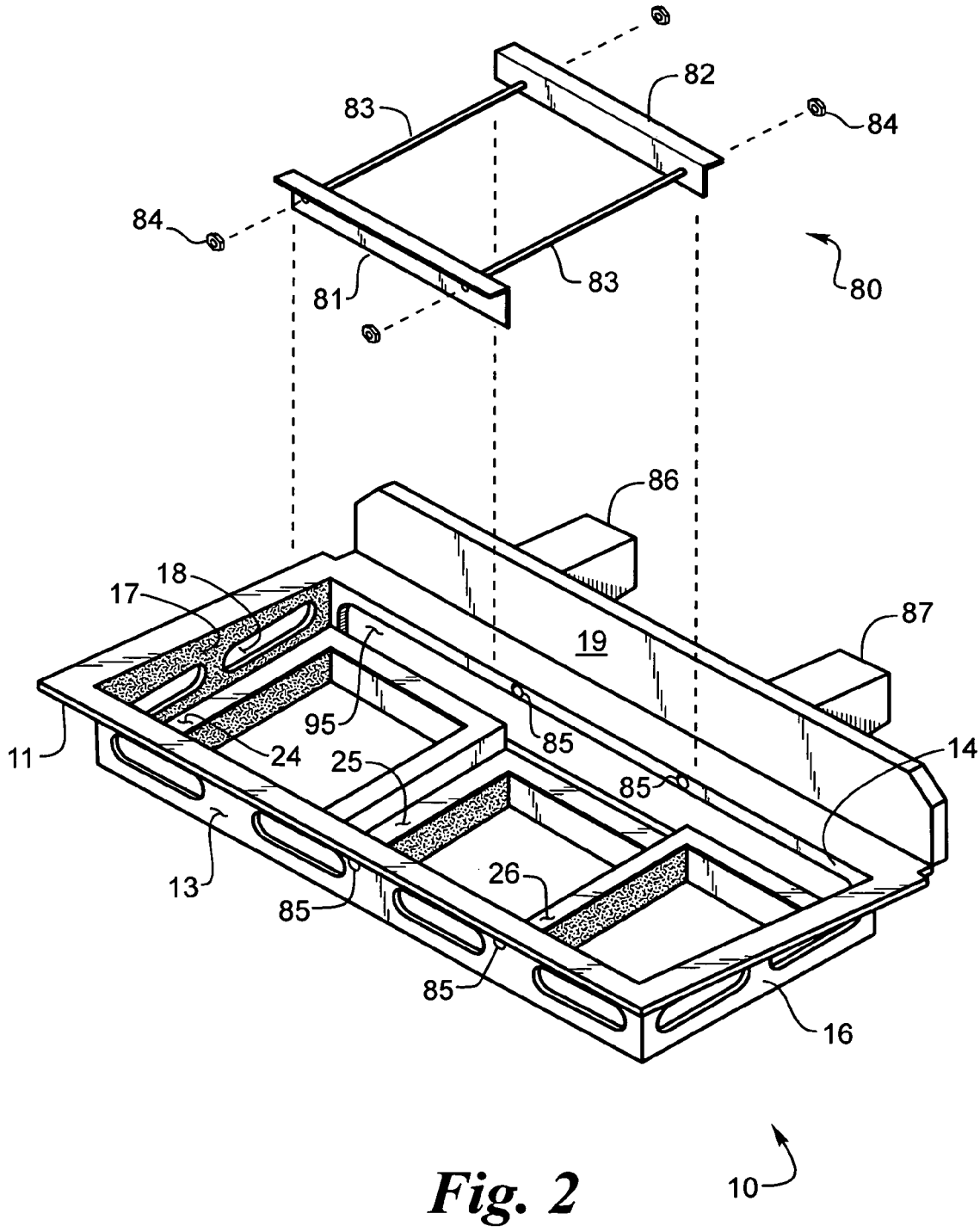
FIG. 2 is a top front perspective view of an insert housing with a support frame prior to insertion.

As shown in FIG. 2 there are overflow openings 18 at the top of each end wall 16, 17 and in the front wall 13 in the insert housing 10 to allow large flows of water through when the apertures 42 in the baskets 40 do not allow sufficient flow therethrough during heavy rains or for allowing water through as the apertures 42 in baskets 40 get blocked by debris.

The walls 16 and 17 of insert housing 10 have a slope along the top sloping downward from the front wall 13 to the back wall 14 to match the slope of the sloped curb box inlet frame wall 55, as shown in FIG. 7. The curb box inlet frame 50 has such a sloped wall to match the slope of the street 57 near the curb 56 to channel water off the street 57 into the curb box inlet frame 50. The design as shown in the figures has a lower center basket 40 allowing for the center basket 40 to fill first, if needed, and the end baskets 40 to fill last, if needed, with the overflow passing through overflow openings 18. In alternative embodiments the slope of the walls 16 and 17 may be different. In another alternative embodiment all baskets 40 may be at the same height in box inlet frame 50.

The trap insert housing 10 (as shown in FIG. 2) has a curb box blocker 19 for blocking water flows though the curb box 53 (as seen in FIG. 7) so that the water flow must pass though the apertures 42 in the baskets 40 or through overflow ports 18 in inset housing 10. In some embodiments there is no curb box 53 so no curb box blocker 19 is required on insert housing 10.

The trap insert housing 10 has frame flanges 24, 25, 26 for supporting the center basket and end baskets 40. The flange 43 on center basket 40 engages flange 25, flange 43 on the left basket engages flange 24 on the trap insert housing 10 and flange 26 engages flange 43 on the right end basket 40. Handles 44 on baskets 40 allow the baskets to be quickly and easily removed from the trap insert frame 10 for cleaning out the baskets 40 and then replacing the baskets. To clean out the baskets first the grate 52 is removed and then the baskets 40 can be removed. Alternatively the baskets 40 may be vacuumed out rather than removed. If silt filters, salt filters, oil filters or chemical filters 30 have been installed in the baskets 40 the filters 30 can be removed and cleaned or removed and replaced with new filters 30. These filters 30 may be bag filters with ties 35 on the base for extending though apertures 42 in the bottom or the sides of baskets 40 and then tied together or tied to the basket 40. The bag filters 30 may have draw strings 37 at the throat of the filter bags to tie the filter bags 30 around the base of the wire frame 31 or underneath the flange 43 of basket 40 or under the flange 143 of frame 140 to secure the bag filters 30 thereto. The ties 35 and or draw strings may be used to secure the bag filters 30 to the baskets 40 such that when vacuumed out the bags remain attached to the baskets 40. Alternatively any means for attaching the filters to the baskets may be used.

In the embodiment shown in FIGS. 1, 2 and 8 the center basket 40 is held by flange frame 25, which is lower than flange frames 24 and 26. This positions center basket 40 lower than the left or right baskets 40 and allows water to flow into the center basket 40 and fill it first, then end baskets 40 are filled. The center basket 40 has the base lower than the other baskets allowing extra flow out of the apertures 42 at the base on the sides adjacent the left and right baskets for extra drainage from the center basket 40.

In an alternative embodiment the trap insert housing 10 and the baskets 40 have uniformly the same height flanges 24, 25, 26 so the baskets 40 are all at the same height.

Figure 5:
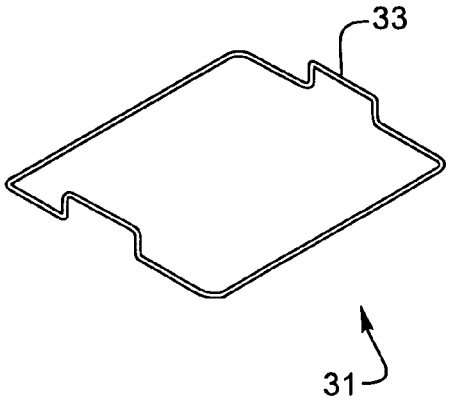
FIG. 5 is a wire filter frame.
Figure 6:
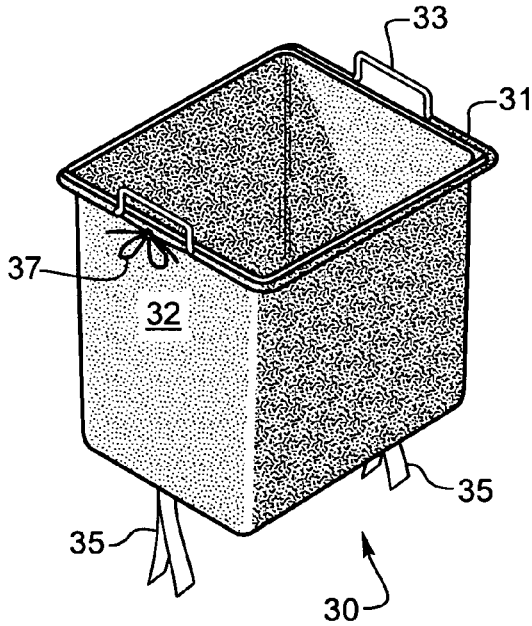
FIG. 6 is a wire filter frame with a filter thereon.

A filter 30 such as a cloth 31 for filtering small particles, or material for absorbing oils, salt, or other chemicals is shown in FIG. 6. The filter 30 has a wire frame 31, as in FIG. 5, with handles 33. The wire frame 31 allows the filter 30 to be set in baskets 40 with the wire frame resting on flanges 43. The filters 30 with handles 33 and can be easily removed from baskets 40 and cleaned or replaced.

Figure 4:
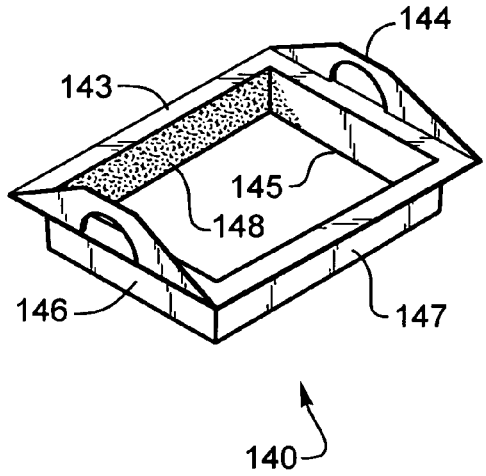
FIG. 4 is a perspective view of a filter holding frame for the insert housing.

In an alternative embodiment as shown in FIG. 4 a filter frame 140 resembling the top portion of a basket 40 may be used to support a filter 30. The filter frame 140 has walls 145, 146, 147 and 148 with a flange 143 running around the top perimeter. The filter frame 140 also has handles 144 attached to the top of the flange for easily removing the filter frame 140 from the insert housing 10. Filter 30 with its wire frame 31 can be supported on flange 143. The filters 30 may thus be easily removed and cleaned or replaced.

As shown in FIG. 7 an inlet 50 has a inlet frame 51 with a grate 52 thereon. An optional curb box 53 allows water to enter curb inlet 54 along the curb wall 56 when water carrying debris is running down the street 57.

As shown in FIGS. 7 and 8 the grate 52 is lifted out of the inlet frame 51 and insert housing 10 can then be dropped into the inlet frame 51. The grate 52 can then be placed on top of the flange 11 of the insert housing 10 to hold the insert housing in place. When it is desired to remove the temporary trap 100 the grate 52 is removed and the insert housing 10 is lifted out of the inlet frame 51. In this manner the temporary trap 100 may be temporarily added to the inlet 50 to prevent debris from entering the sewer. The grate 52 can be lifted and the debris removed, on a regular maintenance schedule, after each rainstorm, or when the baskets 40 become clogged. Alternatively a filter 30 can be inserted into the baskets 40 or filter frame 140 to trap smaller pieces of debris, oils, salts or chemicals by removing the grate 52. The filters 30 may be easily removed and cleaned or replaced.

Figure 9:
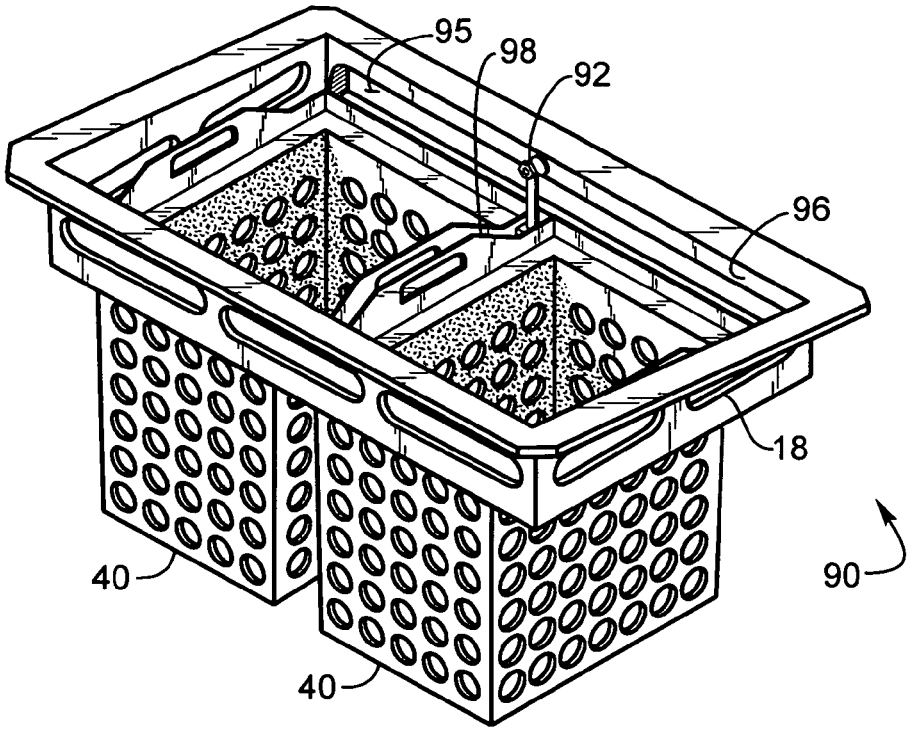
FIG. 9 is a perspective view of a square insert housing for two baskets.
Figure 11:
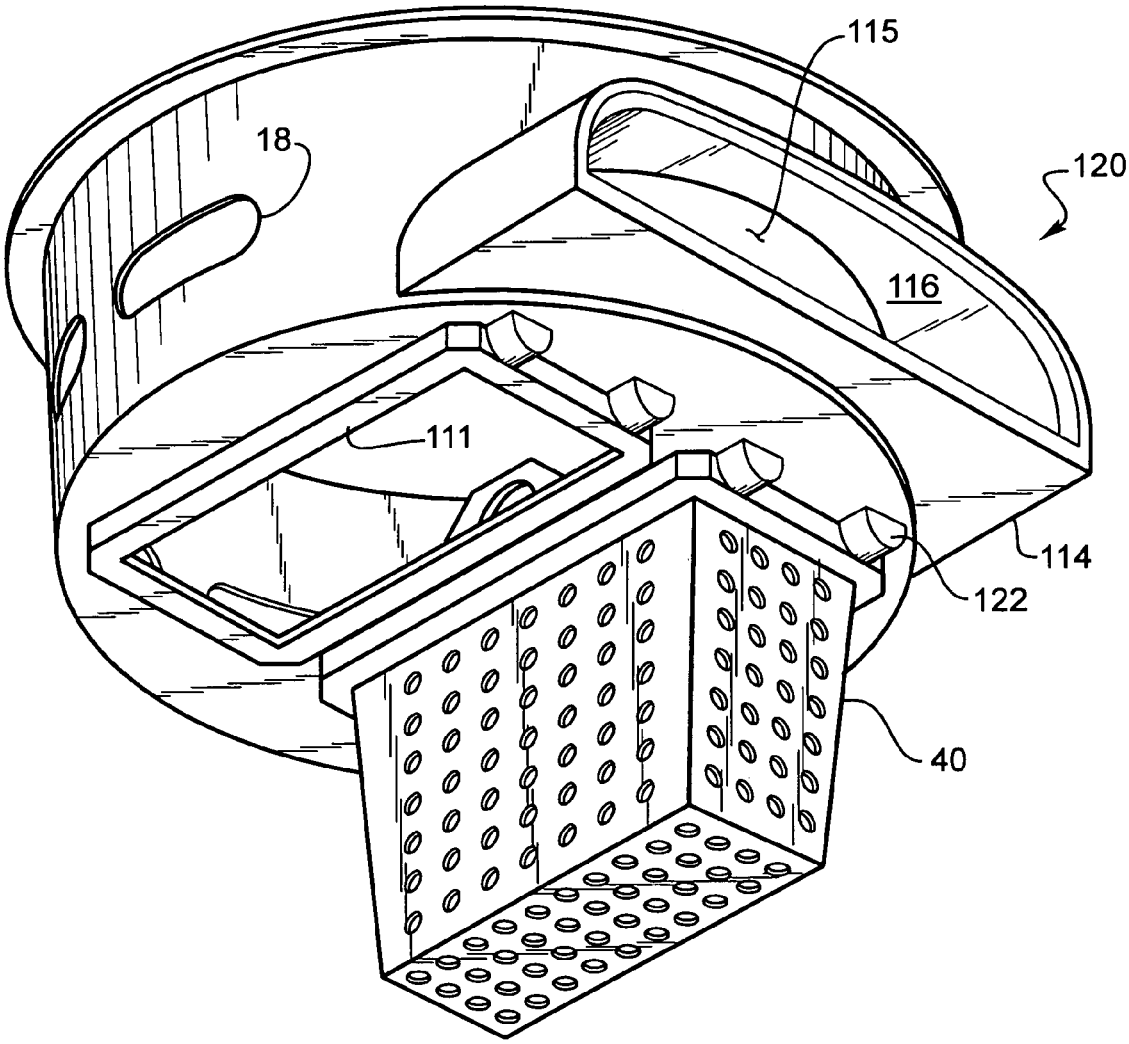
FIG. 11 is bottom perspective view of a round insert housing.
Figure 12:
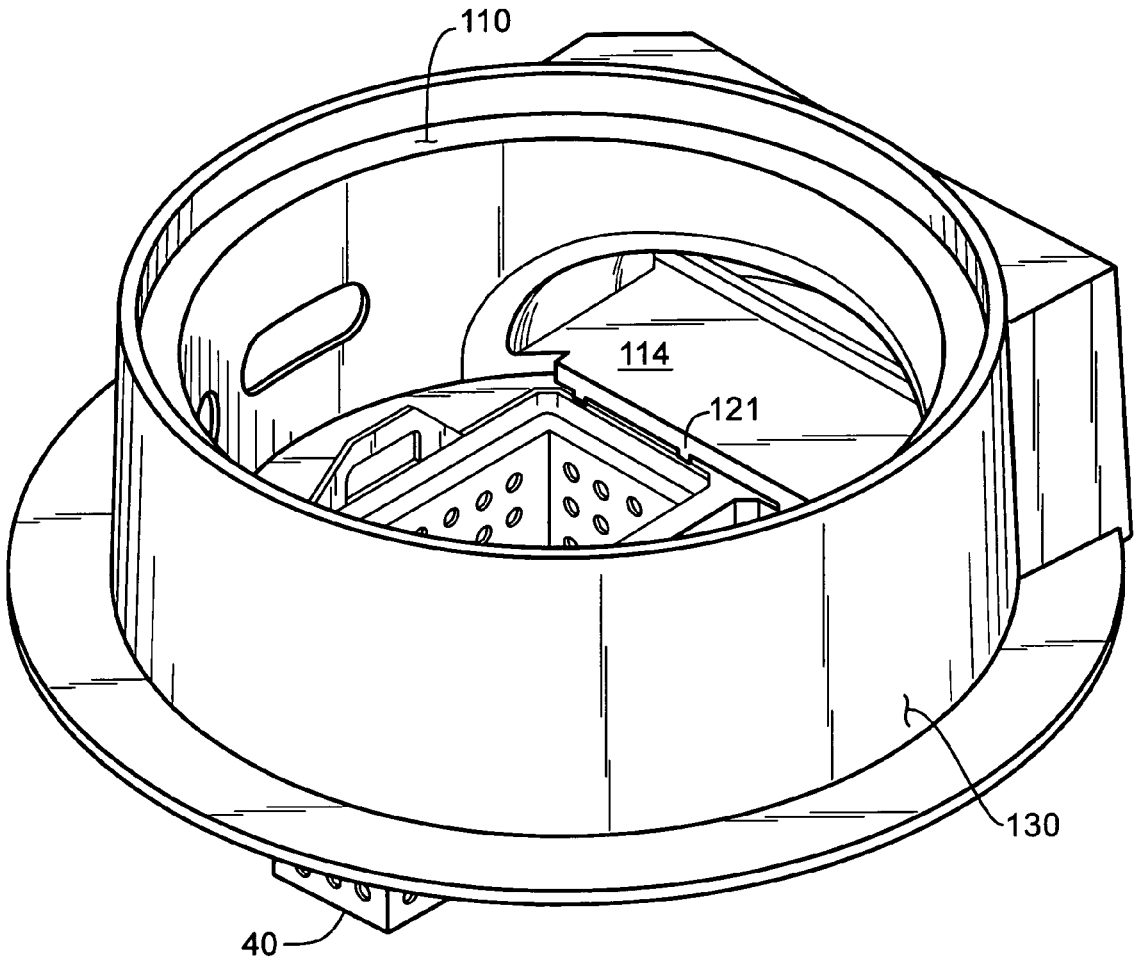
FIG. 12 is top perspective view of a round inlet insert housing in a round curb box inlet frame.

In other embodiments the shapes of the inlet frame 50 may vary from rectangular to square or round and may be moved from adjacent to the curb to the middle of the street. The inlet frame 51 and baskets 40 and silt filter 30 will change shape accordingly. For example in FIGS. 9 and 10 a square two basket insert housing 90 is shown inserted in inlet frame 200. In this embodiment there is a large mouth 95 for overflow into the sewer. The mouth 95 has a base at base plate 98, which is even with the top of baskets 40. The large area of the mouth 95 weakens the insert housing 90 as compared with the front and side walls which have smaller overflow ports 18. A support rod 92 is therefore attached between the base plate 98 and the face plate 96 to add strength to insert housing 90 at the mouth 95. Similarly FIGS. 11 and 12 show a round insert housing 110 having a basket flange 111 for holding baskets 40. A large mouth area 115 is used for overflow. The mouth 115 has a base 114 and a roof mouth 116. As shown, inlet insert 120 is a separate piece added the insert housing 110. The inlet insert 120 has legs 121 for fitting into receiving portion 122 of insert housing 110. The inlet insert 120 fits into inlet frame 130.

Figure 10:
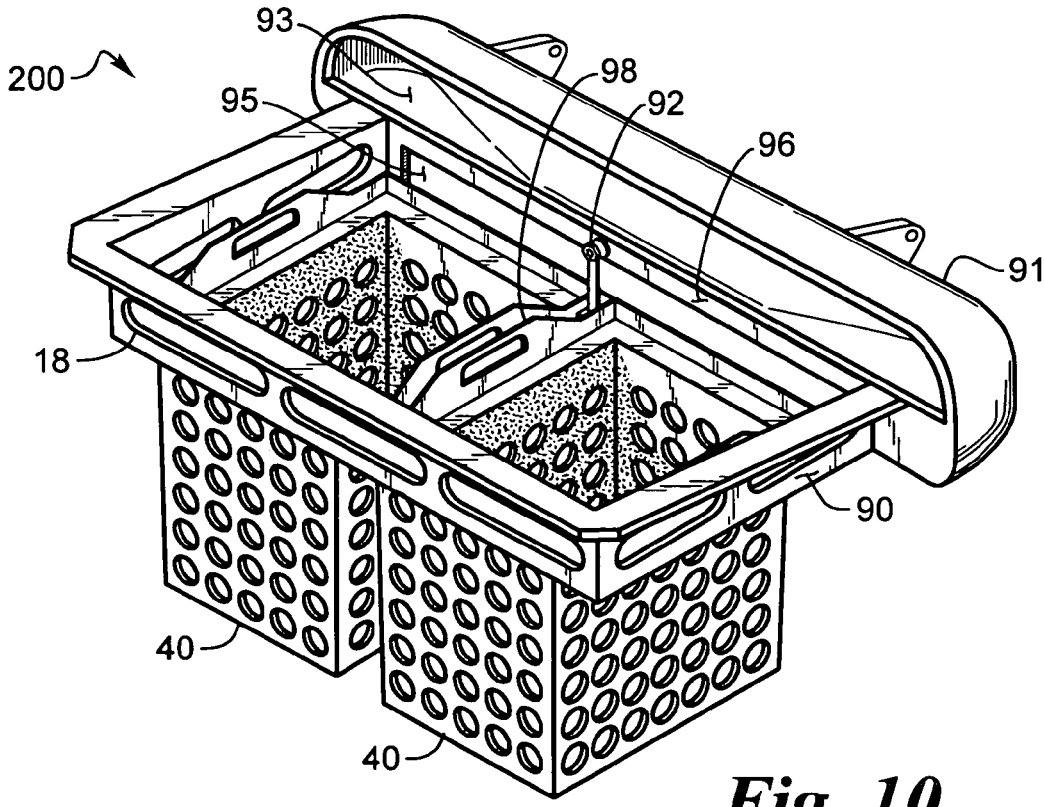
FIG. 10 is a perspective view of a inlet insert for two baskets inset in a square curb box inlet frame.

In some embodiments a casting curb inlet 91, as shown in FIG. 10, is used to allow water running along a curb into the sewer. The water enters curb inlet opening 93 in casting curb inlet 91 and then flows through large mouth 95 in the two basket square insert 90 and into baskets 40 which may have filters 30 therein to separate out debris, silts, sand, oils, salts or chemicals.

The filters 30 may be bags, which can be removed and tied off at the top to trap the debris, oils, salts, or chemicals inside.

The temporary trap 100 is preferably made out of a plastic material or other material, which is inexpensive and disposable.

Although a wire frame 31 or a suitable connection to the handles on the basket is used to support the cloth filter 32 any kind of a frame or support for the cloth filter 32 can be used to keep the cloth in a shape for use with the insert housing 10.

In the embodiments shown the baskets 40 and the filter frames 140 have a rectangular shape however they could be circular or any other shape.

Although the specification above refers to catch basins, the invention can be used with storm, sanitary and catch basins.

Obviously, many modifications and variations of the present invention are possible in light of the above teachings. It is therefore to be understood that, within the scope of the appended claims, the invention may be practiced otherwise than as specifically described.

What is claimed is:

1. A catch basin inlet trap comprising, a trap insert housing having a peripheral wall with a top and a bottom, a flange around the outside perimeter at the top of the trap insert housing peripheral wall for engaging an inlet frame and holding the trap insert housing in place, at least one internal flange on the inside of the periphery of the trap insert housing wall, a matter catching member having at least one outside perimeter flange for engaging the at least one internal flange, at least one aperture in the peripheral wall between the top flange and the internal flange, the top portion of the trap insert frame has front and rear walls of different heights and right and left side walls with a slope matching an inlet frame into which the trap insert housing is inserted.

2. A catch basin inlet trap as in claim 1 wherein, the matter catching member has handles attached to the top thereof.

3. A catch basin inlet trap as in claim 1 wherein, the trap insert housing has a rectangular peripheral wall.

4. A catch basin inlet trap as in claim 3 wherein, a curb box blocker extends upward from the top of the flange on a back peripheral wall to block water flow from entering the catch basin by entering a inlet box thereby bypassing the catch basin inlet trap.

5. A catch basin inlet trap as in claim 3 wherein, three adjacent sets of four flanges attached to the peripheral walls to engage the flanges and support three matter catching members.

6. A catch basin inlet trap as in claim 5 wherein, one of the adjacent sets of flanges is recessed downward relative to the other two sets of flanges.

7. A catch basin inlet trap as in claim 3 having, a base at the bottom of the peripheral walls, the base having at least one aperture with flanges around the at least one aperture for engaging the flanges on the matter catching member.

8. A catch basin inlet trap as in claim 3 wherein, the trap insert housing has a curb box blocker extending upward from the one wall to block water from entering a curb box.

9. A catch basin inlet trap as in claim 1 wherein, the matter catching member has at least one side wall with apertures therein and a bottom having apertures therein.

10. A catch basin inlet trap as in claim 9 wherein, a filter inserted inside of the matter catching member.

11. A catch basin inlet trap as in claim 1 wherein, a filter inserted inside of the matter catching member.

12. A catch basin inlet trap as in claim 11 wherein, the filter has a bag shape with an opening at the top and is inserted into a basket shaped matter catching member.

13. A catch basin inlet trap as in claim 12 wherein, the filter has at least one tie for securing the filter to the matter catching member.

14. A catch basin inlet trap as in claim 12 wherein, a top portion of the bag shaped filter has a folded over portion with a draw string therein to draw the filter opening to a smaller perimeter.

15. A catch basin inlet trap as in claim 11 having, a filter material for filtering grades of sand.

16. A catch basin inlet trap as in claim 11 having, a filter material for absorbing oil.

17. A catch basin inlet trap as in claim 1 wherein, a bar extends over the top of the aperture in the peripheral wall from one side of the trap insert housing to the other side.

18. A catch basin inlet trap as in claim 1 wherein, a support frame having a front flange for engaging a front wall peripheral wall and a rear flange for engaging rear wall peripheral wall with rods connecting the front and rear flanges for providing support for the trap insert housing.

19. A catch basin inlet trap as in claim 1 wherein, the trap insert housing has a cylindrical peripheral wall.

20. A catch basin inlet trap as in claim 19 having, a base at the bottom of the peripheral walls, the base having at least one aperture with flanges around the at least one aperture for engaging the flanges on the matter catching member.

21. A catch basin inlet trap as in claim 1 having, the at least one aperture in the peripheral wall between the top flange and the internal flange has a top and a bottom, with a rod extending from the top to the bottom.

* * * * *